US008966826B2

(12) United States Patent
Kudoh et al.

(10) Patent No.: US 8,966,826 B2
(45) Date of Patent: Mar. 3, 2015

(54) HANDLE BASE ATTACHMENT STRUCTURE

(75) Inventors: Shuichi Kudoh, Kanagawa (JP); Shinji Ichikawa, Kanagawa (JP); Ryuichi Yoshida, Guangzhou (CN)

(73) Assignees: Alpha Corporation, Yokohama-shi, Kanagawa (JP); Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 14/113,001

(22) PCT Filed: Mar. 23, 2012

(86) PCT No.: PCT/JP2012/057638
§ 371 (c)(1),
(2), (4) Date: Oct. 21, 2013

(87) PCT Pub. No.: WO2012/144293
PCT Pub. Date: Oct. 26, 2012

(65) Prior Publication Data

US 2014/0041310 A1 Feb. 13, 2014

(30) Foreign Application Priority Data

Apr. 22, 2011 (JP) ..... 2011-095796

(51) Int. Cl.
*E06B 3/00* (2006.01)
*E05B 1/00* (2006.01)
*E05B 79/06* (2014.01)
*E05B 85/16* (2014.01)

(52) U.S. Cl.
CPC ..... *E05B 1/0053* (2013.01); *E05B 79/06* (2013.01); *E05B 85/16* (2013.01); *Y10S 292/31* (2013.01)
USPC ..... 49/503; 292/336.3; 292/350; 292/352; 292/DIG. 31

(58) Field of Classification Search
USPC ..... 49/503, 506; 292/336.3, 92, 93, 292/DIG. 31, DIG. 65, 347, 350, 352
See application file for complete search history.

(56) References Cited

U.S. PATENT DOCUMENTS 6,471,262 B1 * 10/2002 Schwab ..... 292/336.3
6,523,871 B1 * 2/2003 Josserand ..... 292/347
6,964,439 B2 * 11/2005 Nomura et al. ..... 292/336.3
7,011,349 B2 * 3/2006 Nomura et al. ..... 292/347
7,437,803 B2 * 10/2008 Watanabe et al. ..... 16/412

(Continued)

FOREIGN PATENT DOCUMENTS

JP 2000-226955 A 8/2000
JP A-2000-238537 9/2000

(Continued)

*Primary Examiner* — Jerry Redman
(74) *Attorney, Agent, or Firm* — Drinker Biddle & Reath LLP

(57) ABSTRACT

The door handle device of a vehicle is provided with: a handle base disposed along the rear surface of a door panel; and an operation handle that is coupled to the handle base. The handle base has hook-shaped pressing portions that ride on a protruding portion provided to the oppossed side edges along the sliding direction of a mounting opening provided to the door panel accompanying a sliding operation along the door panel; a panel-abutting portion that sandwiches the door panel in cooperation with the hook-shaped pressing portions; and an elastic locking piece that restricts the rearwards motion of the handle base by resilient locking to the center of a rear end edge of the mounting opening, and restricts removal of the hook-shaped pressing portions from the protruding portion.

6 Claims, 7 Drawing Sheets

(56) References Cited

U.S. PATENT DOCUMENTS

| | | | | |
|---|---|---|---|---|
| 8,042,845 | B2 * | 10/2011 | Tanimoto et al. | 292/336.3 |
| 8,459,706 | B2 * | 6/2013 | Yoshino et al. | 292/336.3 |
| 8,562,039 | B2 * | 10/2013 | Ichikawa et al. | 292/336.3 |
| 8,757,686 | B2 * | 6/2014 | Ishida | 292/336.3 |
| 2002/0059698 | A1 | 5/2002 | Josserand et al. | |
| 2002/0073510 | A1 * | 6/2002 | Muneta | 16/412 |
| 2002/0089194 | A1 * | 7/2002 | Nomura et al. | 292/336.3 |
| 2007/0069533 | A1 * | 3/2007 | Cummins et al. | 292/336.3 |
| 2008/0028885 | A1 * | 2/2008 | Monig | 74/523 |
| 2008/0054652 | A1 * | 3/2008 | Cummins et al. | 292/336.3 |
| 2010/0325841 | A1 * | 12/2010 | Savant et al. | 16/412 |
| 2011/0170305 | A1 * | 7/2011 | Tanaka et al. | 362/501 |
| 2013/0161964 | A1 * | 6/2013 | Ishida | 292/336.3 |
| 2014/0049058 | A1 * | 2/2014 | Kudoh et al. | 292/336.3 |
| 2014/0138962 | A1 * | 5/2014 | Nagata et al. | 292/336.3 |

FOREIGN PATENT DOCUMENTS

| | | |
|---|---|---|
| JP | A-2004-092250 | 3/2004 |
| JP | 2010-126950 A | 6/2010 |
| JP | 2010-209648 A | 9/2010 |
| JP | A-2011-032818 | 2/2011 |

* cited by examiner

HANDLE BASE ATTACHMENT STRUCTURE

TECHNICAL FIELD

The present invention relates to a handle base attachment structure.

BACKGROUND ART

As a structure for fixing a handle base of a door handle device to a door panel, those described in Patent Document 1 are known. In such a related-art example, a front opening and a rear opening are opened in the door panel so as to correspond to both ends of a support (handle base). Further, the fixation of the handle base is made in such a way that a tab formed in the handle base is engaged with a bearing edge formed on the front opening and an outer surface back portion of the rear opening by a sliding operation of the handle base toward the front. When the handle base reaches a final mounting position by being further slidingly operated after the engagement operation of the tab, two arm-shaped elastic arms are elastically fitted and engaged with a rear edge extending in a slit type rearward from both sides of a rear end edge of the front opening and therefore a rearward movement of the handle base is restricted. In this state, an external element is fixed to a rear end of the handle base by a fixation member and therefore a final fixation of the handle base to the panel is completed.

However, there are the following problems in the above related-art example. Specifically, since the fixation member has only a function to draw the external element toward the panel in the above related-art example, the movement of the handle base forward from the final mounting position is restricted by the abutment of the bearing edge and the tab, the movement thereof rearward from the final mounting position is restricted by the abutment of the elastic arms and a front end of the rear edge and the movement thereof in a width direction and a rotation direction from the final mounting position is restricted by the abutment of the elastic arms and a lateral side of the rear edge.

Accordingly, since the final mounting position of the handle base is determined by a rear end position of the elastic arms and a front end position of the rear edge or the like in the above related-art example, there is a drawback that it is not possible to adjust the attachment position even when a positional deviation occurs due to an error of the whole door panel or the front opening during final assembly and therefore a temporary fixation operation is difficult to perform.

RELATED ART DOCUMENTS

Patent Document

Patent Document 1: JP-A-2000-226955

SUMMARY OF THE INVENTION

Embodiments of the present invention relate to an attachment structure of a handle base, a temporary fixation structure of the handle base, a door handle device and an attachment method of the handle base, in which the handle base can be held at a predetermined position until a final mounting of the handle base to a door panel is completed.

MODE FOR CARRYING OUT THE INVENTION

Hereinafter, the embodiments will be described with reference to the drawings. Here, the embodiments are illustrative of the present invention and not intended to limit the present invention. It should be noted that all the features and their combinations described in the illustrative embodiments are not necessarily considered as an essential part of the present invention.

Figure 1:
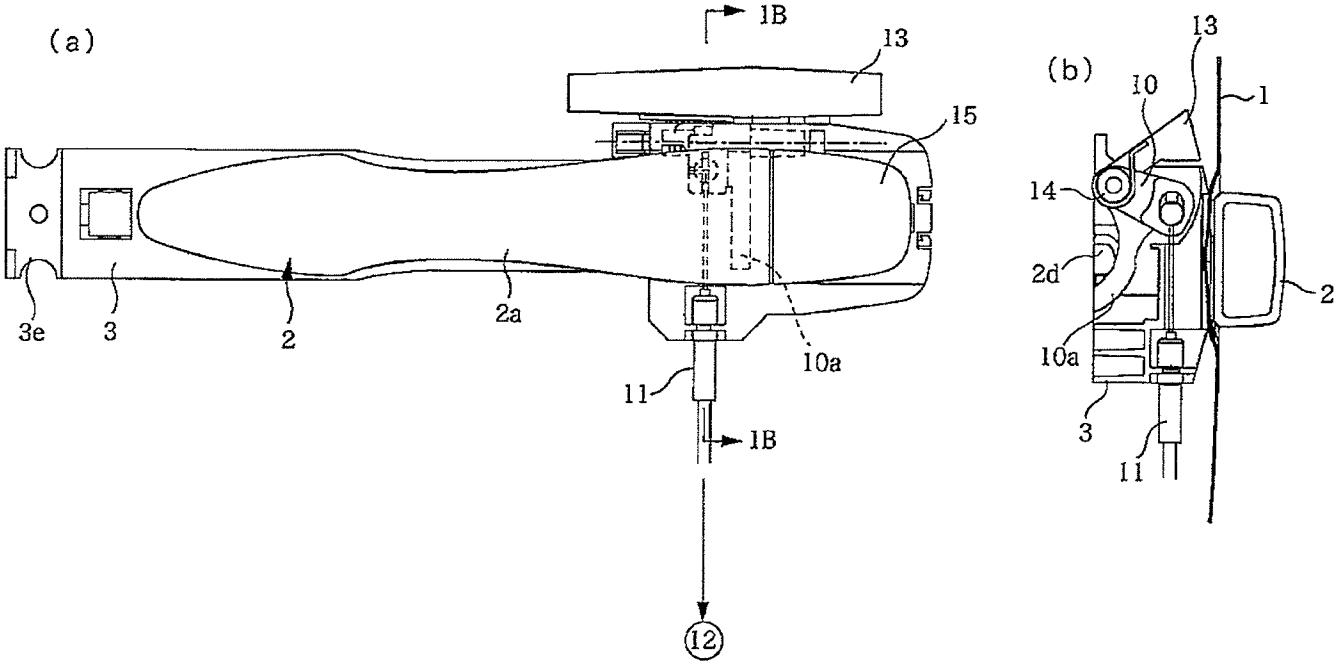
FIG. 1 shows a handle device, in which section (a) is a front view of the handle device and section (b) is a sectional view taken along a line 1B-1B in section (a) of FIG. 1.
Figure 2:
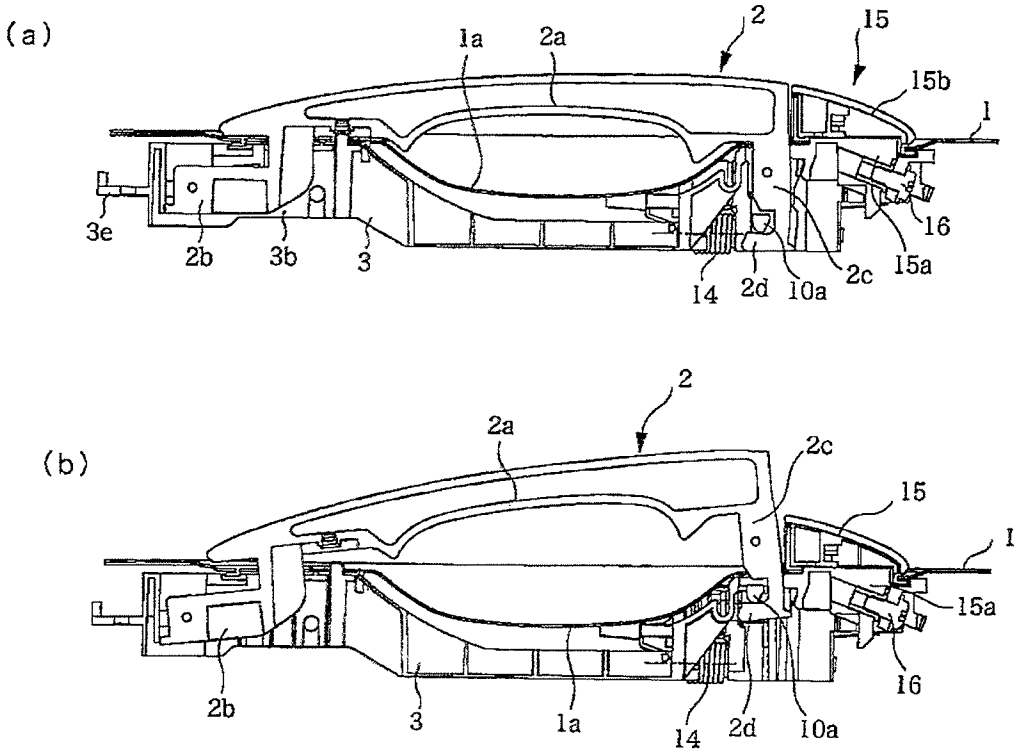
FIG. 2 shows a longitudinal sectional view showing an actuation of the handle device, in which section (a) is a longitudinal sectional view showing an initial state of the actuation of the handle device and section (b) is a longitudinal sectional view showing an operating state of an actuation of the handle device.

As shown in section (a) of FIG. 1 to section (b) of FIG. 2, a door handle device of a vehicle is formed in such a way that an operation handle 2 is rotatably connected to one end of a handle base 3 disposed along a rear surface of a door panel 1. In this embodiment, the handle device is mounted in a posture where a left side thereof in section (a) of FIG. 1 is directed toward the front of a vehicle. Hereinafter, in the present description, with reference to a mounting posture to a vehicle, a longitudinal direction of a vehicle is referred to as "a front and rear".

Figure 3:
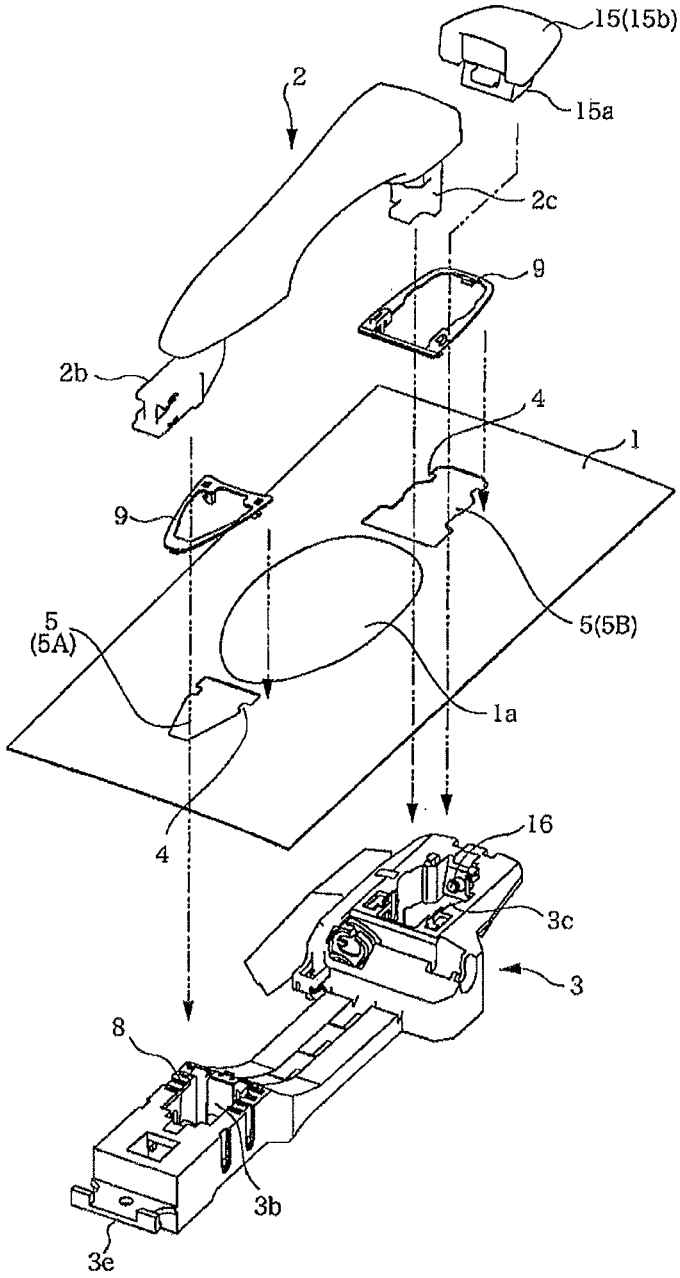
FIG. 3 is an exploded perspective view showing an assembly operation of the handle device.

The operation handle 2 includes a grip portion 2*a* corresponding to a handheld recess 1*a* recessed on a surface of the door panel 1, a hinge leg 2*b* provided on a front end of the grip portion 2*a* and an operation leg 2*c* provided on a rear end thereof. As shown in FIG. 3, the hinge leg 2*b* is inserted into a door body through a front mounting opening 5A opened in the door panel 1, the operation leg 2*c* is inserted into the door body through a rear mounting opening 5B of the door panel 1 and then the whole operation handle 2 is mounted while being slid forward. Gaskets 9 are interposed between the operation handle 2 and the surface of the door panel 1 so as to surround the mounting openings 5.

At the front and rear mounting openings 5, protruding portions 4 are formed by protruding, inwardly, sites of both side edges along a longitudinal direction, which are offset slightly forward from a rear end edge thereof.

When the operation handle 2 in a state of being mounted to the handle base 3 is operated to rotate from an initial rotation position shown in section (a) of FIG. 2 to an operating rotation position shown in section (b) of FIG. 2 about a front end thereof, the operation leg 2*c* is moved in a pull-out direction. Then, a lever 10 is mounted to the handle base 3 by locking an actuation arm 10*a* to a locking end 2*d* formed on the operation leg 2*c* and driven to rotate when an operating force is applied to the actuation arm 10*a*. In response to this, a door lock device 12 disposed in a door body is actuated through a cable device 11 connected to the lever 10.

Further, in the present embodiment, a counterweight 13 is mounted to the handle base 3 in coaxial with the lever 10 and cancels an inertia force generated in the operation handle 2 when a side collision force is applied to a vehicle, so that an inadvertent door opening operation of the operation handle 2 is prevented.

Figure 4:
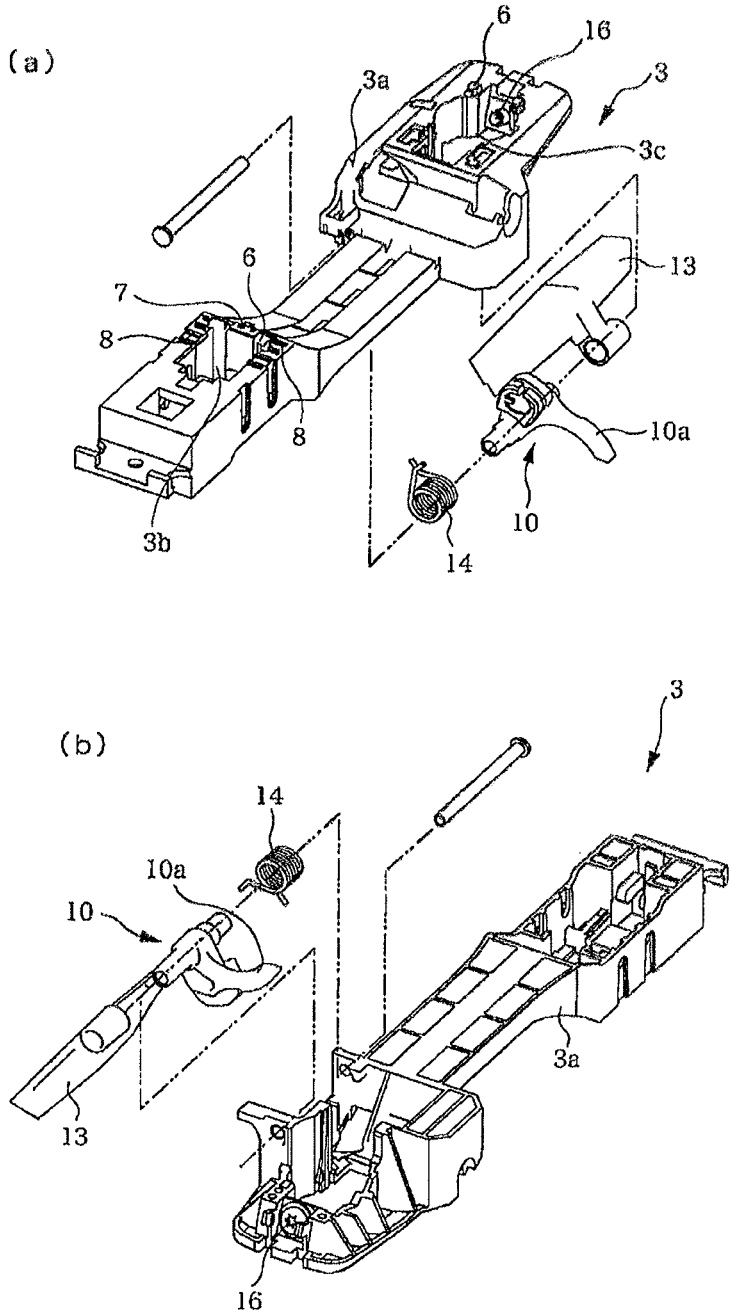
FIG. 4 shows an exploded perspective view of a handle base in which section (a) is an exploded perspective view of the handle base as viewed from the front side and section (b) is an exploded perspective view of the handle base as viewed from the rear side.

As shown in section (a) of FIG. 4, the handle base 3 is formed by mounting the lever 10, the counterweight 13, a torsion spring 14 and a connecting screw 16 for a fixation member 15 to a base body 3*a* that is made by an injection molding of synthetic resin material, for example.

As shown in section (a) of FIG. 5, the base body 3*a* includes a front opening 3*b* for accommodating the hinge leg 2*b* of the operation handle 2 and a rear opening 3*c* for accommodating the operation leg 2*c* of the operation handle 2 and a shaft portion 15*a* of the fixation member 15 (to be described later). Each of the front opening 3*b* and the rear opening 3*c* has substantially the same shape as the front and rear mounting openings 5 of the door panel 1. Hook-shaped pressing portions 6 are formed near the rear end portions of the side edges of the front opening 3*b* and the rear opening 3*c* and an elastic locking piece 7 is provided in a rear end edge of the front opening 3*b*.

Figure 5:
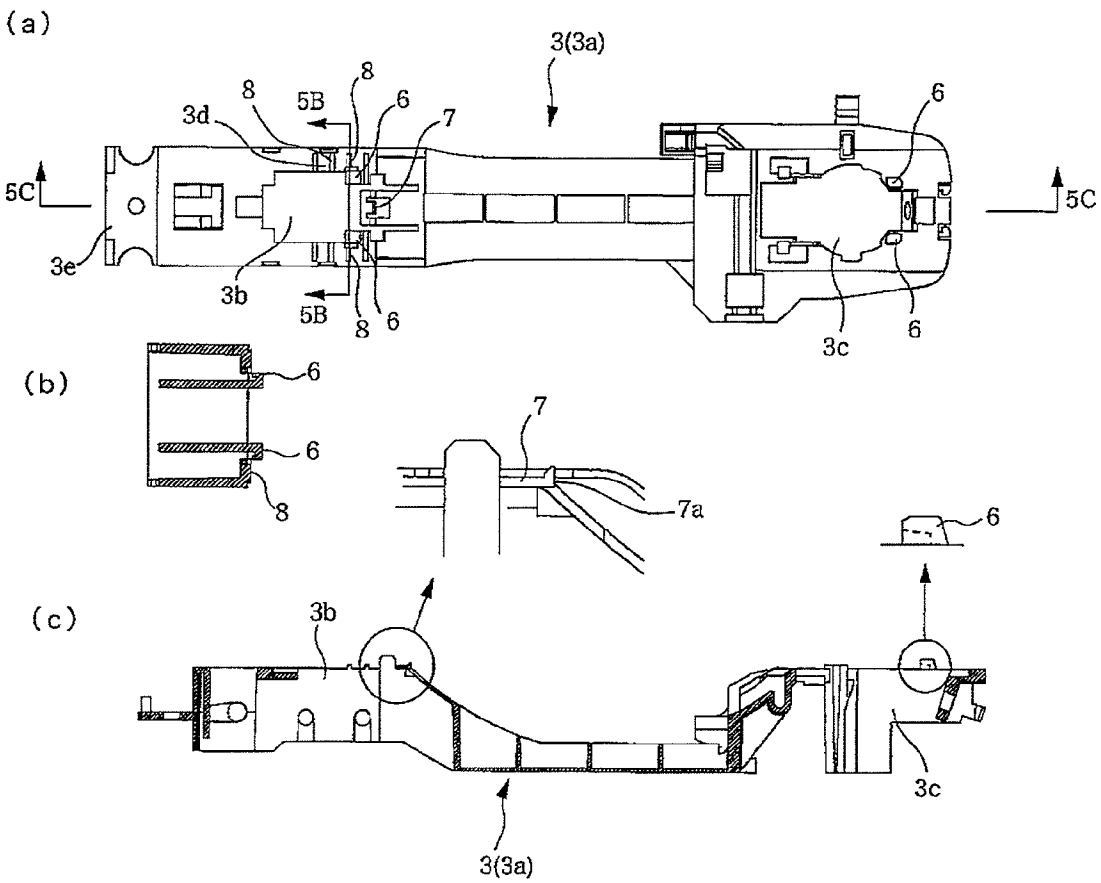
FIG. 5 shows the handle base, in which section (a) is a front view of the handle base, section (b) is a sectional view taken along a line 5B-5B in section (a) of FIG. 5 and section (c) is a sectional view taken along a line 5C-5C in section (a) of FIG. 5.
Figure 6:
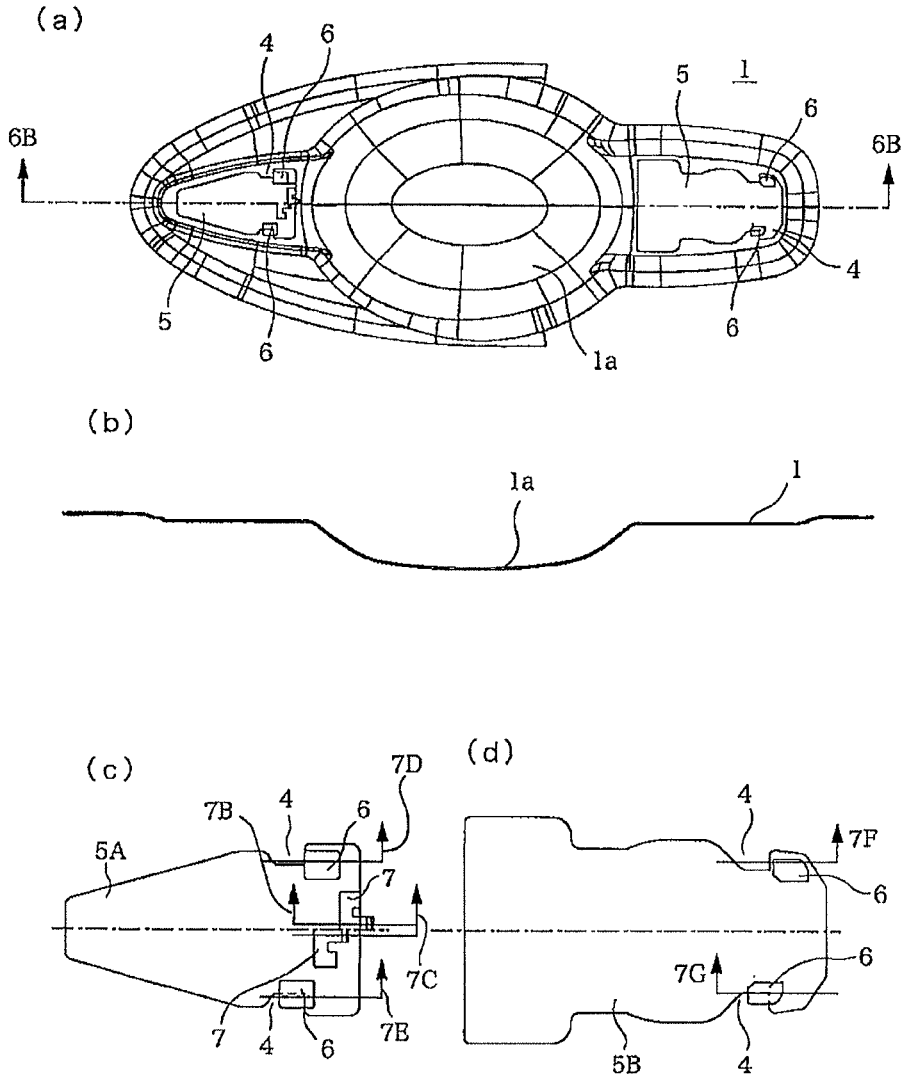
FIG. 6 are views showing an operation of the embodiment, in which section (a) is a front view, section (b) is a sectional view of a door panel taken from a line 6B-6B in section (a) of FIG. 6, section (c) is a view showing a front mounting opening, and section (d) is a view showing a rear mounting opening.

As shown in section (a) of FIG. 5 to section (d) of FIG. 6, each of the hook-shaped pressing portions 6 is formed in a position and size that allow the hook-shaped pressing portion to be inserted through a gap portion between the rear end edges of the protruding portions 4 formed on the front and rear mounting openings 5 of the door panel 1 and the rear end edges of the mounting openings 5. The hook-shaped pressing portions 6 protrude from a surface of the base body 3*a* serving as a panel-abutting portion 8. These hook-shaped pressing portions 6 have a bag shape having a closed rear end, which is opened to a widthwise outer side and to the front.

Figure 7:
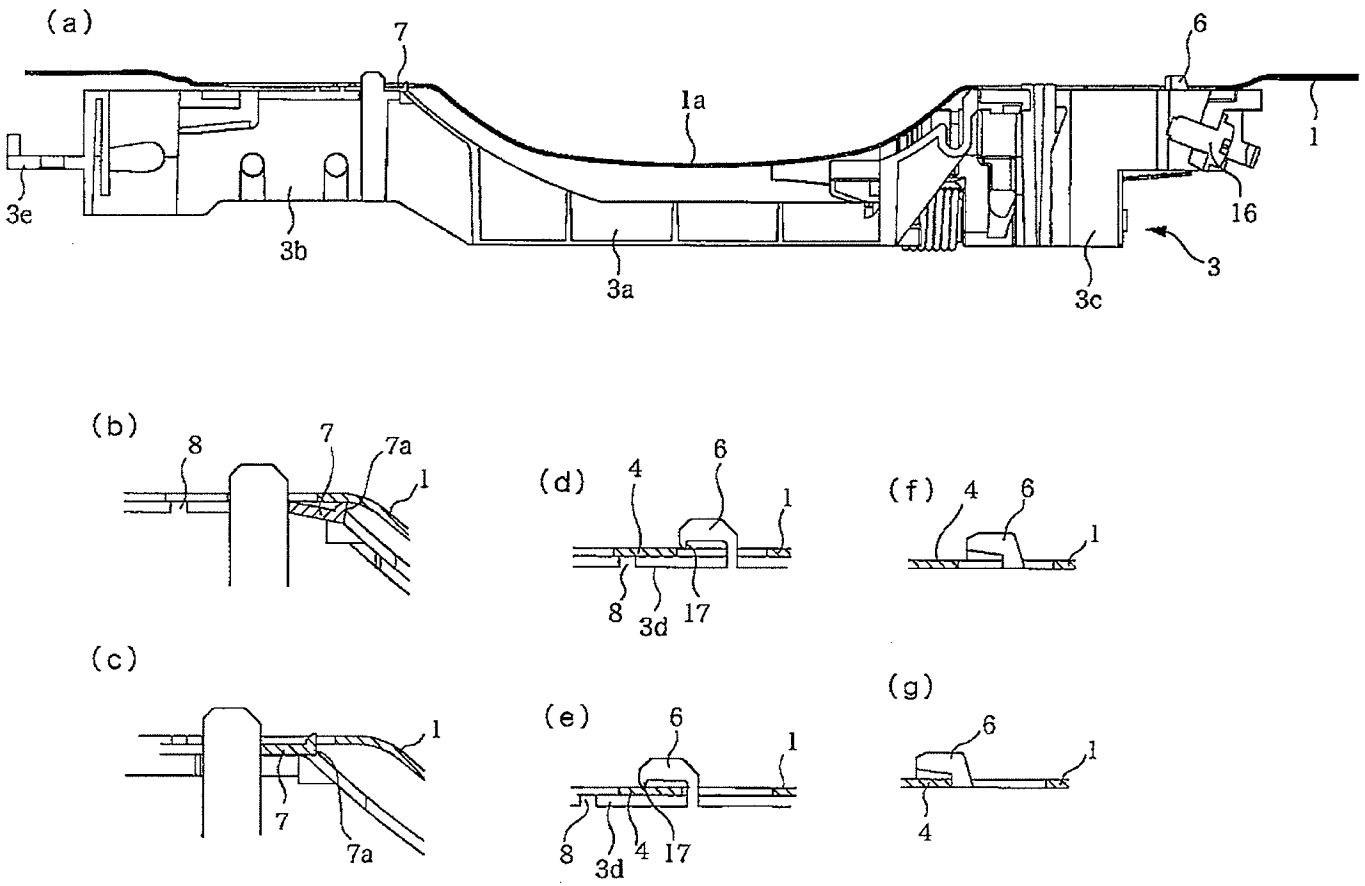
FIG. 7 shows a temporary fixation operation of the handle base, in which section (a) is a longitudinal sectional view, section (b) is a sectional view taken along a line 7B in section (c) of FIG. 6, showing an elastic locking piece at the start of mounting, section (c) is a sectional view taken along a line 7C in section (c) of FIG. 6, showing the elastic locking piece at the completion of mounting, section (d) is a sectional view taken along a line 7D in section (c) of FIG. 6, showing a hook-shaped pressing portion at the start of mounting, section (e) is a sectional view taken along a line 7E in section (c) of FIG. 6, showing the hook-shaped pressing portion at the completion of mounting, section (t) is a sectional view taken along a line 7F in section (c) of FIG. 6, showing the hook-shaped pressing portion at the start of mounting, section (g) is a sectional view taken along a line 7G in section (c) of FIG. 6, showing the hook-shaped pressing portion at the completion of mounting.

Further, at the front edge of the hook-shaped pressing portion 6 of the front opening 3*b*, a pressing ridge 17 having a V-shaped section is formed over the entire length thereof, as shown in section (d) of FIG. 7. The pressing ridge 17 protrudes to a position where the pressing ridge 17 slightly bites the panel-abutting portion 8 and a concave furrow 3*d* is formed on the surface of the base body 3*a* facing the pressing ridge 17. As a result, the door panel 1 is in a state of being slightly bent since both ends thereof are supported by a pair of adjacent panel abutting portions 8 and a central portion thereof is pressed by the pressing ridge 17. In this way, it is possible to prevent the backlash or the like.

On the other hand, the elastic locking piece 7 is projected rearward from a center of a rear end edge of the rear opening 3*c* in a state of an elastically deformable cantilever and a pressing surface 7*a* made of a vertical surface is formed at a free end of the elastic lock piece 7.

The handle base 3 configured as described above is mounted to the door panel 1 by inserting the hook-shaped pressing portions 6 into the front and rear mounting openings 5, as shown in section (a) of FIG. 6 to section (g) of FIG. 7. In section (a) of FIG. 6, section (c) of FIG. 6 and section (d) of FIG. 6, an initial state of a mounting operation is shown at an upper side of a centerline and a mounting completion state is shown at a lower side of the centerline.

As shown in section (d) of FIG. 7 and section (f) of FIG. 7, in an inserted state of the hook-shaped pressing portion 6, an opening portion of the hook-shaped pressing portion 6 to the front faces a rear end edge of the protruding portion 4 and the elastic locking piece 7 abuts against the door panel 1 and is elastically bent, as shown in section (b) of FIG. 7.

When the handle base 3 is moved forward from this state, the hook-shaped pressing portion 6 covers the rear end of the protruding portion 4 to sandwich the protruding portion 4 in cooperation with the panel-abutting portion 8, as shown in section (e) of FIG. 7 and section (g) of FIG. 7.

When the handle base 3 is further slid forward from this state, the free end of the elastic locking piece 7 enters the rear mounting opening 5 by an elastic restoring force thereof. Thereafter, the rearward movement of the handle base 3 is restricted by the pressing surface 7*a*.

When the elastic locking piece 7 enters the rear mounting opening 5 and the rearward sliding is prohibited, the hook-shaped pressing portion 6 is already located on the protruding portion 4. Thereafter, the handle base 3 is prevented from moving in a plate-thickness direction of the door panel 1. As a result, the handle base 3 is prevented from being detached from the door panel 1.

A sliding operation of the handle base 3 to the front can be made until the hook-shaped pressing portion 6 provided on either of the rear opening 3*c* or the front opening 3*b* abuts against the front end edge of the protruding portion 4. In this case, a movable distance from the position shown in FIG. 7 until the pressing surface 7*a* of the elastic locking piece 7 abuts against the rear end edge of the rear mounting opening 5 can be used as a position adjustment margin.

The fixation of the handle device to the door panel 1 is made by mounting the operation handle 2 to the door handle in a state where the handle base 3 is temporarily fixed in the above-described manner and then finally fixing the handle base 3 to the door panel 1 using a fixation portion 3*e* of the front end of the handle base and the fixation member 15. As shown in FIG. 2, the fixation member 15 is formed by protruding a shaft portion 15*a* from a pressing head 15*b* exposed to the surface of the door panel 1 in a state of being mounted and the fixation operation is made in such a way that the shaft portion 15*a* inserted through the rear mounting opening 5 and the rear opening 3*c* of the base body 3*a* is fastened to the base body 3*a* by the screw 16.

The fixation member 15 is pulled-in obliquely rearward in a vehicle width direction by the fastening of the screw 16 and the door panel 1 is sandwiched by the pressing head 16*b* and the surface of the base body 3*a*. As a result, the base body 3*a* is fixed to the door panel 1 so as not to be detached therefrom.

According to the above embodiment, an attachment structure of the handle base 3 disposed on a rear surface of the door panel 1 and supporting the operation handle 2 that is mounted from a front surface side of the door panel 1 may include the mounting opening 5 provided in the door panel 1 and temporarily fixing the handle base 3 therein, a pair of protruding portions 4 provided in a peripheral edge of the mounting opening 5, the hook-shaped pressing portions 6 that ride on the pair of protruding portions 4 provided in the handle base 3 and the locking piece 7 abutting against the peripheral edge of the mounting opening 5 other than the pair of protruding portions 4 provided in the handle base 3. The handle base 3 may be temporarily fixed to the door panel 1 by the hook-shaped pressing portion 6 and the locking piece 7.

Further, according to the above embodiment, a temporary fixation structure of the handle base for temporarily keeping, in the door panel 1, the handle base 3 disposed along a rear surface of the door panel 1 and supporting the operation handle 2 that is mounted from a front surface side of the door panel 1 may include a pair of mounting openings 5 opened to the door panel 1 and including a pair of protruding portions 4 at opposite side edges thereof so as to correspond to both ends of the handle base 3, the hook-shaped pressing portion 6 provided in the handle base 3 and riding on the protruding portions 4 in accordance with a sliding operation along an edge of each mounting opening 5 on which the protruding portions 4 are formed and the elastic locking piece 7 provided in the handle base 3 and entering the mounting opening 5 on a leading side of sliding in accordance with the sliding operation. The handle base 3 may be configured such that the detachment thereof in a panel plate-thickness direction is restricted by sandwiching the door panel 1 with the hook-shaped pressing portions 6 and the panel-abutting portion 8 to a rear surface of a peripheral edge of the mounting opening 5 and the movement thereof in a slide retreat direction is restricted while the movement thereof in a slide direction is allowed by the elastic locking piece 7 within a range where the hook-shaped pressing portion 6 rides on the protruding portions 4.

According to the above structure, the mounting of the handle base 3 is made by sliding the handle base 3 along a rear surface of the door panel 1. In the mounted state, both ends of the handle base are temporarily held at predetermined positions by sandwiching the door panel 1 using the hook-shaped pressing portion 6 and the suitable panel-abutting portion 8. It is necessary to position the hook-shaped pressing portion 6 on the protruding portion 4 in order to maintain the temporary holding state and the elastic locking piece 7 prevents the detachment of the hook-shaped pressing portion 6 by restricting the rearward movement of the handle base 3.

It is not necessary to cause the hook-shaped pressing portion 6 to be pressurized, as long as the hook-shaped pressing portion can sandwich the door panel 1 in cooperation with the panel-abutting portion 8 to a rear surface of a peripheral edge of the mounting opening 5. However, it is possible to suppress shaking until the completion of the final fixation when a suitable pressurized protrusion or the like is formed in an abutting portion to the door panel 1 and cooperates with the panel-abutting portion 8 to sandwich the door panel in a pressurized state.

Generally, in an operation to fix a door handle device to a door panel, an operation handle is mounted, from a front surface of the door panel, to a handle base temporarily fixed to a rear surface of the door panel of a vehicle and then the handle base is finally fixed using suitable fixation means. When the handle base is unintentionally detached from the door panel before mounting of the operation handle, degradation of the assembly workability is caused. Further, for example, a cable device for remotely operating a door lock device installed in a door body is mounted to the handle base in a temporary fixation state. Therefore, since a detachment operating force from the door panel is applied to the handle base by the influence of the contact to the cable device in other process or the elastic posture restoring force of the cable device itself, it is necessary to perform the temporary fixation of the handle base with a sufficient force to overcome the detachment operating force. Furthermore, in a so-called grip-type handle device, a relatively long operation handle is generally arranged along a vehicle longitudinal direction. For this reason, since even a small deviation of an attachment position is noticeable, fine adjustment in the final fixation is required and it is necessary to satisfy both the movability for fine adjustment and the fixability for detachment prevention.

Meanwhile, according to the structure of the above embodiment, since the rearward movement of the handle base 3 is set by the relationship between the hook-shaped pressing portion 6 and the protruding portion 4, it is possible to securely prevent the degradation of workability due to the detachment of the handle base 3 from the door panel 1 during assembly operation and it is also possible to finely adjust the fixation position in the final fixation operation. In addition, there is no case that immoderate dimensional accuracy for the mounting opening 5 or the handle base 3 is required.

The elastic locking piece 7 can be suitably formed in an arm shape or the like and the locked portion of the mounting opening 5 can be suitably formed in a slit shape or the like, in correspondence with the shape of the elastic locking piece.

Meanwhile, a rear end edge of the front mounting opening 5 may have a substantially U shape and the elastic locking piece 7 may be formed at a position where the elastic locking piece can be locked to a center of the rear end edge of the mounting opening 5.

According to this structure, it is not necessary to form the slit or the like and therefore the shape and structure of the front mounting opening 5 and the elastic locking piece 7 can be simplified.

In the above structure, the hook-shaped pressing portion 6 may be formed to have a longitudinal dimension that is slightly smaller than a gap between the rear end edge of the mounting opening 5 and a rear end of the protruding portion 4 and the elastic locking piece 7 may be formed to have a width dimension that is slightly smaller than a dimension between the hook-shaped pressing portions 6 to be opposed to each other.

According to this structure, since the sandwich function for the door panel 1 and the detachment prevention function can be concentrated near the rear end of the mounting opening 5, the remaining regions of the mounting opening 5 can be effectively used as an insertion space of the hinge leg of the operation handle 2 to the mounting opening 5, for example. As a result, it is possible to reduce the size of the mounting opening 5 as much as possible.

Further, according to the above embodiment, the door handle device of a vehicle may include the handle base 3 disposed along a rear surface of the door panel 1 and the operation handle 2 coupled to the handle base 3. The handle base 3 may include the hook-shaped pressing portion 6 that rides on the protruding portion 4 provided at the opposed side edges in a sliding direction of the mounting opening 5 opened in the door panel 1 in accordance with a sliding operation along the door panel 1, the panel-abutting portion 8 that sandwiches the door panel 1 in cooperation with the hook-shaped pressing portion 6 and the elastic locking piece 7 that is resiliently locked to a center of the rear end edge of the mounting opening 5 to restrict the rearward movement of the handle base 3 and to restrict the detachment of the hook-shaped pressing portion 6 from the protruding portion 4.

Further, according to the above embodiment, a handle base attachment method for attaching, on a rear surface of the door panel 1, the handle base 3 supporting the operation handle 2 that is mounted from a front surface side of the door panel 1 may include a step of providing the mounting opening for temporarily fixing the handle base 3 to the door panel 1, a step of providing a pair of protruding portions 4 on a peripheral edge of the mounting opening 5, a step of providing, on the handle base 3, the hook-shaped pressing portion 6 that rides on the pair of protruding portions 4 and the locking piece 7 abutting against the peripheral edge of the mounting opening 5 other than the pair of protruding portions 4, a step of temporarily fixing the handle base 3 to the door panel 1 by the hook-shaped pressing portion 6 and the locking piece 4.

According to the structure and method of the embodiments, since the handle base can be held at a predetermined position until a final mounting of the handle base to the door panel is completed, it is possible to improve the assembly workability.

DESCRIPTION OF REFERENCE NUMERALS AND SIGNS

1 Door Panel
2 Operation Handle
3 Handle Base
4 Protruding Portion
5 Mounting Opening
6 Hook-shaped Pressing Portion
7 Elastic Locking Piece
8 Panel Abutting portion

The invention claimed is:

1. An attachment structure of a handle base disposed on a rear surface of a door panel and supporting an operation handle that is mounted from a front surface side of the door panel, the attachment structure of the handle base comprising:

a mounting opening provided in the door panel for temporarily fixing the handle base therein;

a pair of protruding portions provided in a peripheral edge of the mounting opening;

hook-shaped pressing portions that are provided in the handle base and that ride on the pair of protruding portions; and a locking piece that is provided in the handle base and that abuts against the peripheral edge of the mounting opening at a position of the peripheral edge of the mounting opening that does not define the pair of protruding portions, wherein the handle base is temporarily fixed to the door panel by the hook-shaped pressing portions and the locking piece.

2. The attachment structure of the handle base according to claim 1, wherein, during a sliding operation in which the handle base is translated relative to the door panel in a slide direction, the hook-shaped pressing portions are adapted to ride on the protruding portions along an edge of each mounting opening on which the protruding portions are formed, and the locking piece includes an elastic locking piece that is provided in the handle base and is adapted to enter the mounting opening on a leading side of the mounting opening during the sliding operation in the slide direction, such that detachment of the handle base in a panel plate-thickness direction is restricted by sandwiching the door panel with the hook-shaped pressing portions and a panel-abutting portion of the handle base to a rear surface of the peripheral edge of the mounting opening and movement of the handle base in a slide retreat direction opposite the slide direction is restricted while the movement of the handle base in the slide direction is allowed by the elastic locking piece within a range where the hook-shaped pressing portions ride on the protruding portions.

3. The attachment structure of the handle base according to claim 2, wherein a rear end edge of a front mounting opening has a substantially U shape and the elastic locking piece is formed at a position on the handle base where the elastic locking piece can be locked to a center of the rear end edge of the front mounting opening.

4. The attachment structure of the handle base according to claim 3, wherein the hook-shaped pressing portions have longitudinal dimensions that are slightly smaller than gaps between the rear end edge of the front mounting opening and rear ends of the protruding portions and the elastic locking piece is formed to have a width dimension that is slightly smaller than a dimension between the hook-shaped pressing portions to be opposed to each other.

5. The attachment structure of the handle base according to claim 1, wherein, during a sliding operation in which the handle base is translated relative to the door panel in a sliding direction, the hook-shaped pressing portions are adapted to ride on the protruding portions provided at the opposed side edges in a sliding direction of the mounting opening in the door panel, a panel-abutting portion of the handle base is adapted to sandwich the door panel in cooperation with the hook-shaped pressing portions and the locking piece is adapted to be resiliently locked to a center of a rear end edge of the mounting opening to restrict rearward movement of the handle base and to restrict detachment of the hook-shaped pressing portions from the protruding portions.

6. A handle base attachment method for attaching, on a rear surface of a door panel, a handle base supporting an operation handle that is mounted from a front surface side of the door panel, the handle base attachment method comprising:

providing a mounting opening for temporarily fixing the handle base to the door panel, providing a pair of protruding portions on a peripheral edge of the mounting opening, providing, on the handle base, hook-shaped pressing portions that ride on the pair of protruding portions and a locking piece abutting against the peripheral edge of the mounting opening at a position of the peripheral edge of the mounting opening that does not define the pair of protruding portions, and temporarily fixing the handle base to the door panel by the hook-shaped pressing portions and the locking piece.

* * * * *